US006016579A

United States Patent [19]

Erbs

[11] Patent Number: 6,016,579

[45] Date of Patent: Jan. 25, 2000

[54] LIQUID DRAIN APPARATUS INCORPORABLE WITHIN A COUNTER TOP

[76] Inventor: Harold J. Erbs, P. O. Box 232, Taylor, Tex. 76574

[21] Appl. No.: 09/036,193

[22] Filed: Mar. 7, 1998

Related U.S. Application Data

[63] Continuation-in-part of application No. 08/870,612, Jun. 6, 1997.

[51] Int. Cl.[7] ..... A47K 77/06

[52] U.S. Cl. ..... 4/631; 4/291

[58] Field of Search ..... 4/631, 637, 287–291

[56] References Cited

U.S. PATENT DOCUMENTS

| | | | |
|---|---|---|---|
| 1,333,433 | 3/1920 | Maisano | 4/289 |
| 2,505,305 | 4/1950 | Schaefer | 4/289 |
| 2,721,333 | 10/1955 | Stanitz | 4/637 |
| 3,578,737 | 5/1971 | Ruggles | 4/631 |
| 5,369,815 | 12/1994 | Martin | 4/287 |
| 5,715,547 | 2/1998 | Becker et al. | 4/656 X |

*Primary Examiner*—Charles E. Phillips

*Attorney, Agent, or Firm*—Beirne Maynard & Parsons, L.L.P.

[57] ABSTRACT

A liquid drain apparatus for incorporation within a counter top intended for use within tops for laboratories and hospitals, or the like. The drain profile provides a series of ribs and valleys within a base horizontally angled from a higher outboard end to a deeper inboard end so that liquid drainage will collect through the drain profile and be directed toward a draining receptacle included or placeable in the drain profile. The draining receptacle, which may be used independent of the drain profile, includes a cylindrical body and a basket having a series of ports and slots to permit maximum drainage flow as the basket fills with entrapped solids.

2 Claims, 5 Drawing Sheets

U.S.
C
C
100
114
D
D
D
C
CT
S

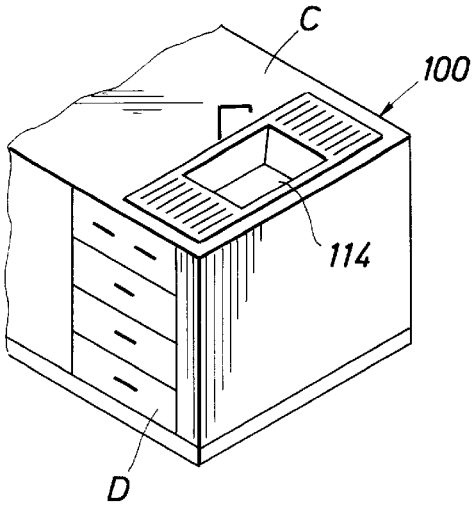
FIG. 1A
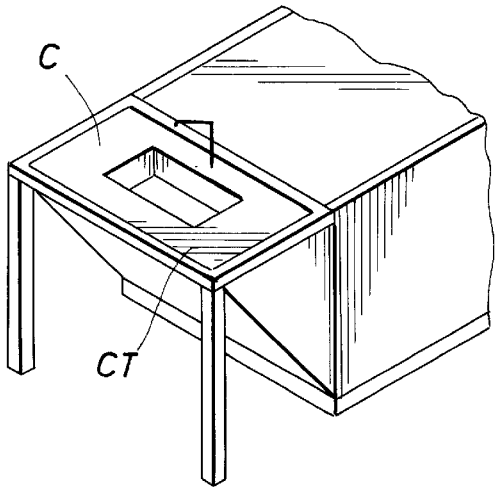
FIG. 1B
(PRIOR ART)
FIG. 2
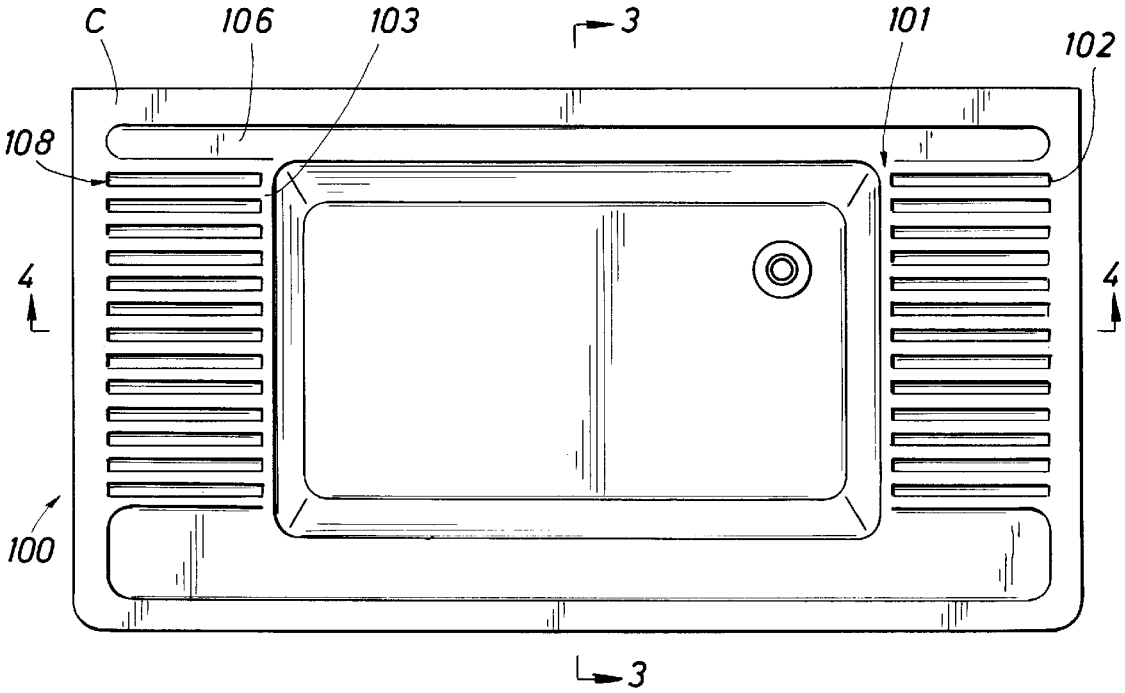

LIQUID DRAIN APPARATUS INCORPORABLE WITHIN A COUNTER TOP

CROSS-REFERENCE TO RELATED APPLICATION

This application is a continuation-in-part application of co-pending application Ser. No. 08/870,612, filed Jun. 6, 1997, and entitled "Liquid Drain Profile and Top Edge Member For Incorporation Within a Counter Top".

BACKGROUND OF THE INVENTION (1) Field of the Invention

The invention relates to a liquid drain apparatus for incorporation within a counter top useful in, for example, laboratory and hospital work areas.

(2) Brief Description of the Prior Art

Work surfaces incorporated into furniture and other areas in laboratories and hospital environments and also provided as tops for storage facilities and the like, are exposed to many abrasive solids and liquid chemicals of varying potential hydrogen ("pH") readings. They must thus be designed and manufactured to be capable of withstanding exposure and contact with acids, bases, various medicinal components, and numerous chemical compositions, as well as resisting exposure to both high and low temperatures, in extremes, and numerous combinations of gaseous and solid components. Quite frequently, these tops for work areas receive spill-overs or spillage from containers used for testing, mixing, or the like.

Prior art tops have simply provided a work area which has disposed therein a drainage receptacle, such as a conventional sink or the like, with the possible inclusion of hot and cold water outlets for placing the water into the drainage receptacle, resulting in the laboratory top surrounding the drainage receptacle having to be cleared of chemical liquid residual by means of usage of towels and the like which may incorporate a chemical cleaner either in the towel or a towel being used in combination with such cleaner, of conventional and commercial known composition and availability.

Moreover, such prior art and conventional laboratory tops often times do not have any upwardly extending outer edge, resulting in accumulated liquids being able to be easily and inadvertently caused to run down the sides of cabinetry or be dropped or spilled onto the floor in an area around the drainage area, sometimes resulting in the floor becoming very slippery or otherwise being a cause of accidents and injury to human safety, as well as property loss, such as damage and rotting to cabinet works. Even when such conventional laboratory tops do have an outer edge upwardly extending wall, such walls are at a substantially vertical relationship to the horizontal lower surface resulting in an approximate 90° angle at the intersection between the upwardly extending wall and the lower surface. This angled relationship between the wall and the lower surface may result in splashing of sensitive chemicals, such as low pH acid solutions which have collected on the counter top onto clothing of technicians working in the laboratory or, even more seriously, onto hands and other skin areas of humans.

In the particular environments within which the present invention is contemplated for use, it can be expected that the drainage fluid discharged through the liquid drain apparatus will include not only tap water but acid and basic chemicals of varying concentrations as well as medicinal liquids, atomic trace chemicals, and the like, each of which may also include solid particulate matter which, if permitted to completely pass through the drainage assembly into a discharge conduit or sewer line could cause corrosion, clogging or otherwise have a deleterious impact.

The present invention addresses and provides a solution to such problems so typical of prior art counter tops and drainage assemblies.

SUMMARY OF THE INVENTION

The present invention provides a liquid drain apparatus for incorporation within a counter top for use in, for example, laboratory and hospital work environments. The drain apparatus comprises at least one epoxy resin-based solid body having an outer end and inward end defined within the top. The body has a given height which is defined from a first height point and also includes a smooth top surface which defines a second height point. The drain profile also includes a plurality of parallel ribs which are vertically defined through the body and have sloping walls within the body which extend upwardly through the given height from the first height point and which terminate at substantially the second height point. Valley members are disposed between each of the ribs, with the valley members being provided in "U"-shaped configuration. The valley members extend vertically upwardly from the first height point, and each of the valley members have a plurality of vertically sloping valley wall elements which also define the walls of the ribs. The valley members are horizontally defined within the body between the outboard and inboard ends. The drainage apparatus also provides a collection area within the body and adjacent the body inboard end for receipt of a draining receptacle, such as a trough or epoxy sink. The height of the valleys from the outboard end to the inboard end gradually and horizontally increases there between, and are rounded and smoothed to simplify cleaning, whereby the flow of drainage liquid collecting between the valleys and the ribs is urged gravitationally for collection within the collection area.

The drain apparatus includes a drainage receptacle, which may be disposed within the collection area during manufacture of the drain apparatus to combine the solid body with the drainage receptacle. Preferably the solid body will be provided in a manner such that the collection area may receive the desired drainage receptacle upon insertion of same while the solid body is being installed within the laboratory top. The drainage receptacle may be rectangularly shaped in the form of a trough or sink having a bottom which includes an opening as well as a plurality of vertically disposed parallel walls which extend from the bottom and intersect at each end thereof with complementary end wall sections. The bottom member of the trough or other shaped draining receptacle may be provided such that it angularly slopes toward the opening relative to the parallel walls from one of the end walls toward the other of the end walls.

The liquid drain apparatus of the present invention includes a circular shoulder extending to the opening in the drainage receptacle for receipt of a solids trap assembly. The solids trap assembly may be used independent of the present and particular draining receptacle and/or liquid drain apparatus solid body. The solids trap assembly includes an elongated cylindrical body having an outwardly extending lip for positioning the cylindrical body along the shouldered opening. Means, such as threads, are provided for securing the cylindrical body to the draining receptacle. Additional means, such as a second series of thread profiles, are provided for securing a drainage conduit to one end of the cylindrical body. An inwardly protruding shoulder extends around the interior of the cylindrical body immediate one end thereof and a removable basket is provided which is insertable within the cylindrical body and includes a lower end intersecting a continuous side wall. The basket is positionable upon and removable from the inwardly protruding shoulder by hand manipulation. Finally, the solids trap component or assembly of the present invention further includes an annular flow area defined between the exterior of the wall of the basket and the interior of the cylindrical body.

The basket includes a series of ports having a first size disposed through the basket lower end and a series of rectangularly-shaped slot openings vertically and radially disposed through and around the side wall, with each of the slot openings being larger than the first sized opening through the ports to permit drainage fluid flow therethrough into the angular area and thence through the drainage conduit, and to screen particulate matter for retention within the basket.

The solid body component of the present invention may also include a top edge member which has a lower surface area in substantial horizontal alignment with the outboard end of the solid body and may also include an inner wall area surrounding the lower surface area which extends upwardly and slopingly away from the surface area toward a second and higher surface area in a partial circularly configured orientation. Additionally, the top edge member may also include a curved outer sidewall extending between the second and higher surface area and a substantially vertical outer edge as well as away from the lower surface area.

The top edge member may also be provided for use independent of the drain apparatus and may serve as an outer edge of a laboratory top of known configuration and composition.

The drain apparatus may be incorporated within the counter top within a number of selected and desired configurations. For example, the apparatus may be provided such that the collection area for receipt of the draining receptacle is in substantially the middle and between two or more drain profile elements. Alternatively, the collection area for receipt of the draining receptacle, or the draining receptacle itself, may be slightly offset within the counter top such that only one drain apparatus is required which would be placed on only one side of the collection area. Additionally, the drain apparatus may be defined within the counter top so that it completely surrounds a collection area.

While the preferred drain apparatus and counter top incorporating same is preferably illustrated herein in a rectangular configuration, it will be appreciated to those skilled in the art that it may also be provided in a circular or similar configuration whereby the ribs and valleys extend compatibly and circularly or otherwise around and toward a companion circularly configured collection area and/or draining receptacle.

The length of the drain apparatus incorporating the ribs and valleys as herein disclosed is not particularly critical to the successful usage of the present invention, it only being required that the inboard end of the ribs and receptacles communicate with the draining receptacle in such fashion that the fluid drainage received within the valleys between the respective ribs is gravitationally disposed toward and transmitted into the collection area. In other words, the drain apparatus including the ribs and valleys of the present invention may extend completely across the entire counter top, or, alternatively, only a selected portion thereof with that portion of the counter top not including the ribs and valleys which extend away from the drain apparatus being of conventional nature and configuration.

Moreover, it is contemplated that the counter top including the drain apparatus and configuration of the present invention may be provided in such a manner that the counter top is angled horizontally, somewhat, such that liquid on the flat surface portion of the counter top may be easily directed toward and within the drain apparatus at the outboard ends or edges thereof.

BRIEF DESCRIPTION OF THE DRAWINGS

FIG. 2 is a perspective view looking downwardly upon the drain apparatus of the present invention.

DESCRIPTION OF THE PREFERRED EMBODIMENTS

Figures 1, 1A, 1B:
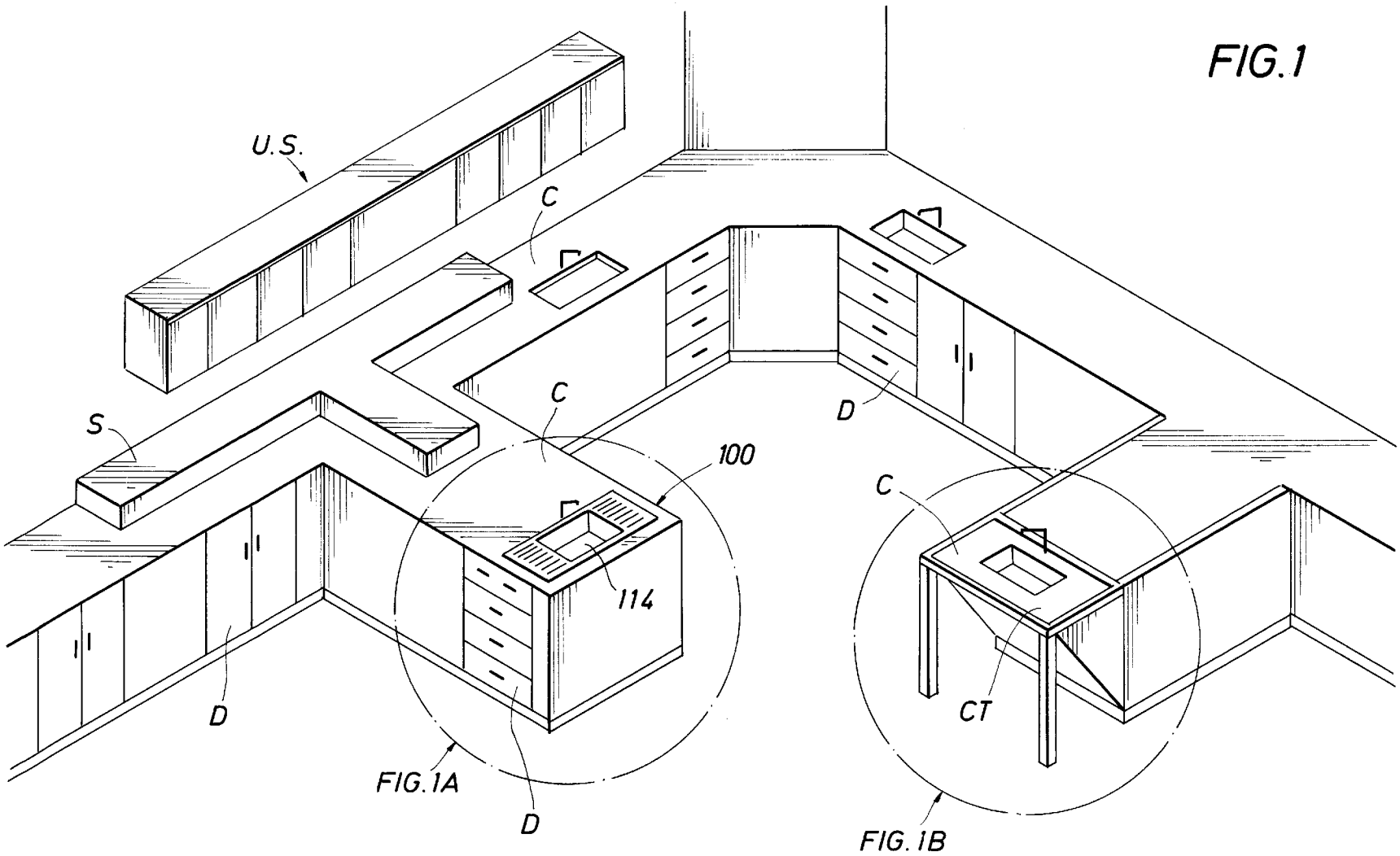
FIG. 1 is an overall view showing a typical laboratory work area.
FIG. 1A includes a perspective view included within FIG. 1 of the drain apparatus of the present invention.
FIG. 1B is a portion of the laboratory work area shown in FIG. 1, illustrating a typical prior art laboratory counter top configuration with a sink or trough being disposed therein.

With first reference to FIG. 1, there is shown an overall perspective view of a typical laboratory work area containing upper shelving U.S. as well as a profiled work or storage area adjoining counter top C. Drawers of typical configuration D are also shown.

Now, with reference to FIG. 1A, the liquid drain apparatus 100 of the present invention is shown within a counter top C. As illustrated in FIG. 1A, a drainage receptacle, such as rectangular or square sink 114 is included within apparatus 100.

Now referring to FIG. 1B (Prior Art) there is shown a conventional laboratory counter top C which does not include the liquid drain apparatus 100 of the present invention, but does show conventional flat counter top configuration CT.

Turning to FIGS. 2, 3, 3A, 3B, 4, 5 and 6, there is shown the liquid drain apparatus 100 of the present invention disposed within the counter top C. At least one epoxy resin-based solid body 101 is provided within the drain apparatus 100. The body 101 has an outward, or outboard, end 102, as well as inboard, or inward end 103. The body 101 is made of an epoxy resin-based material, of known and conventional composition and available from numerous commercial sources known to those skilled in the art.

The body 101 has a given height 104 (FIG. 3) and includes a first height point 105 (FIG. 4) as well as a smooth top surface 106 (FIG. 2). A second height point 107 (FIG. 4) is also provided.

Figure 3:
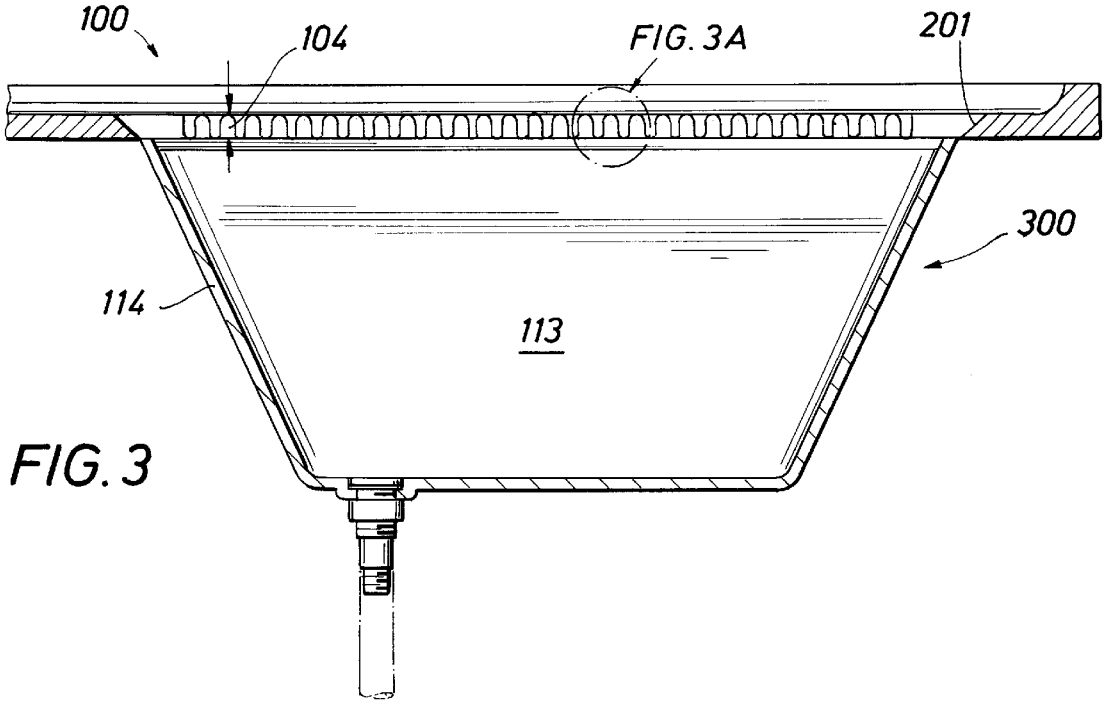
FIG. 3 is a cross-sectional view taken along line 3—3 of FIG. 2.
Figure 3A:
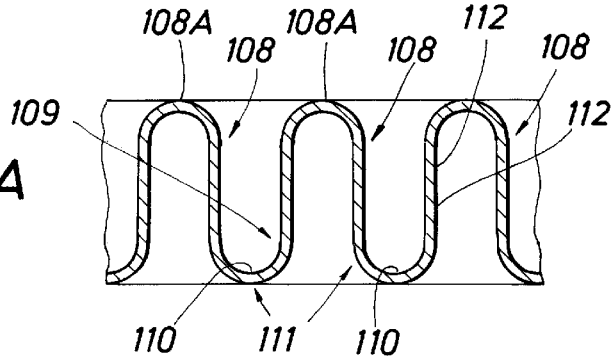
FIG. 3A is a cross-sectional view taken along line 3—3 of FIG. 3, illustrating the "U"-shaped configuration of the ribs and valleys.

Now with particular reference to FIG. 3A, the apparatus 100 includes a plurality of parallel rib elements 108 extending vertically from the outboard end 102 (FIG. 2) of the solid body 101 to the inboard end 103 thereof. Each of the parallel ribs 108 contain sloping walls 109 which extend lowerly and slopingly inwardly toward intersecting valley members 110 such that valley members 110 and rib walls 109 appear as a "U"-shaped configuration 111. The top 108A of the ribs 108 may be squared off, or, as shown in FIG. 3A, may be curved to provide a convexing profile. The sloping walls 109 of the parallel ribs 108 also define the upwardly extending valley wall components 112 of the valley members 110: they are one and the same, in reality. The valley members extend to fluid flowing communication with a collection area 113 within the drain apparatus 100, and the collection area 113 may simply be left as an open area during manufacture of the drain apparatus 100 for receipt of a draining receptacle component 300, such as a sink or trough, introduced within the collection area 113 during on-site assembly of the drain apparatus 100 in the laboratory or hospital work area. Alternatively, the apparatus 100 may be manufactured to include the drainage receptacle within the collection area 113 and then shipped as a one piece component for further assembly within the counter top C at the work site.

Figure 6:
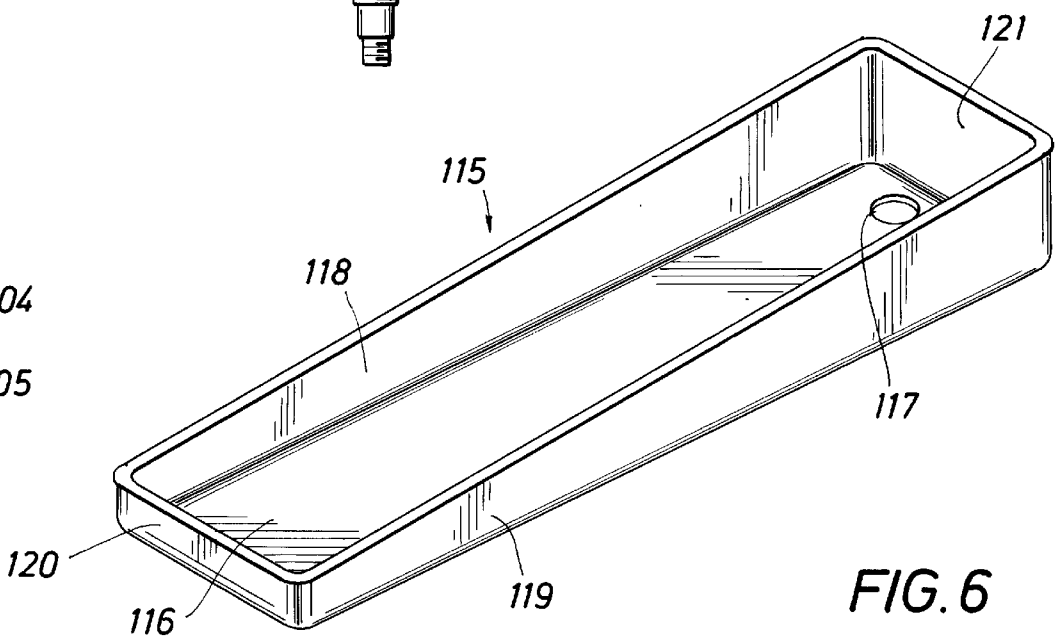
FIG. 6 is a perspective illustration of the draining receptacle of the present invention.

The drainage area may be provided in the form of a rectangularly shaped trough 115, such as that shown in FIG. 6. The trough includes a slopping bottom 116 as well as a drain port 117. Parallel walls 118, 119 extend upwardly from the bottom 116 of the trough 115 with each end of the walls 118, 119 respectfully intersecting one of the end walls 120, 121 for sealing containment of liquid within the trough as it is being directed toward the drain port 117 for ultimate disposal.

Figure 7:
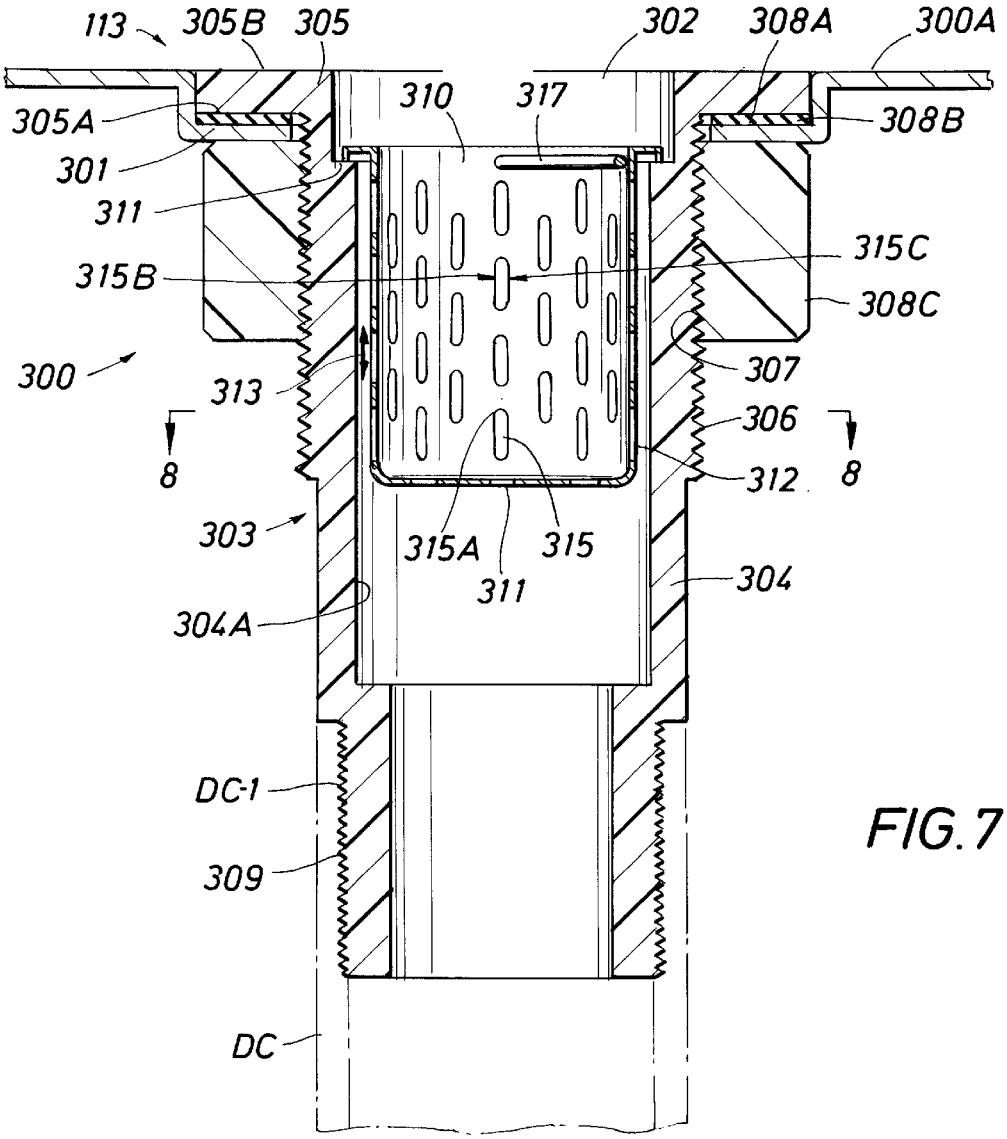
FIG. 7 is a partial cross-sectional view of the draining receptacle with the removable basket operationally disposed therein.
Figure 8:
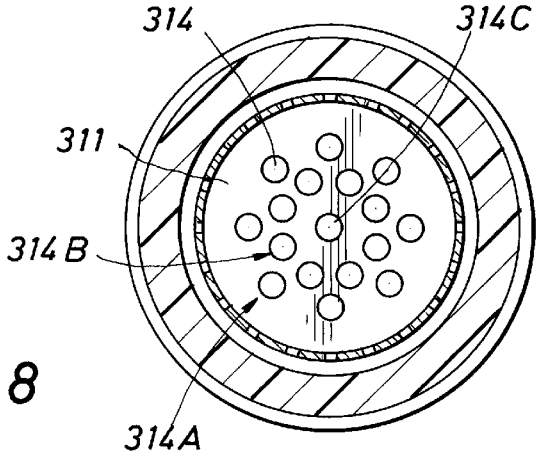
FIG. 8 is a cross-sectional view of the removable basket taken along lines 8—8 of FIG. 7 and illustrates the sizing and arrangement of the ports and slot openings.

Now, with particular reference to FIGS. 7 and 8, the draining receptacle 300 is shown in significant detail as positioned within the collection area 113. The drainage receptacle 300 includes an opening 302 for receipt of drainage fluid and contaminants circularly terminating at a profiled shoulder 301 for receipt of a solids trap assembly 303 thereon. The solids trap assembly 303 consists of two basic sub-components: an elongated cylindrical body 304 within which is received a removable basket 310. The elongated cylindrical body 304 has at its uppermost end an outwardly protruding or extending lip member 305 having an upper face or surface 305B in substantial horizontal alignment with its companion and continuing surface 300A in the drainage receptacle 300. Likewise, the outwardly extending lip 305 has similarly extending but lower face 305A which, when engagement of the assembly 303 is made relative to the drainage receptacle 300, comes into securement with an upper face 308A of a locking washer member 308B. A lock or tight-securing ring 308C provides securement between the elongated cylindrical body 304 and the drainage receptacle 300 and is hand manipulated into locking engagement during assembly in known fashion. Threads 306 exteriorly positioned circumferentially around the elongated cylindrical body 304 mate with the threads 307 on the locking ring 308C.

The cylindrical body 304 also includes an inwardly protruding circumferentially extending shoulder 311 immediate the upper opening 302 upon which the removable basket 310 is rested when it is in place within the body 304, as described below. An inner wall 304A is provided lowerly of the shoulder 311 and interior of the cylindrical body 304, the wall 304A and the continuous outer side wall 312 of the removable basket 310 defining an angular flow area 313 within the body 304 for directing fluid flow, as described below.

The lower end of the cylindrical body 304 has a series of outwardly extending circumferentially profiled mating threads 309 for companion engagement with threads DC-1 on a drainage conduit DC which is secured to the assembly 303 either at the factory or on site. If a tight-securing ring 308*c* is used, or similar device, the mating threads 309 may be replaced by use of a conventional clamp, in known fashion.

Now, with particular reference to FIGS. 7 and 8, the removable basket 310 has a lower end 311 through which a series of ports having a first size 314 have been radially bored therethrough. In order to assure a continuous and effective rate of flow through the basket 310, it is preferred that each of the first sized ports 314 be bored in rows which are slightly offset from one another, as in rows 314A versus row 314B, with a final or center port 314C bored at substantially the center of the lower end 311.

Typically, the basket 300 will be made of stainless steel, aluminum or other metallic surface which is resistant to corrosion and/or adverse effects caused by extreme low or high pH fluids or contaminants. Alternatively, the basket 300 may be made of a plastic or an epoxy resin material.

A handle 317 is provided on the basket which may be rotated by hand such that it is snugly housed within the interior of the basket 310 when positioned within the elongated cylindrical body 304, but is manipulatable by application of a finger when it is desired to retrieve the basket 310 from the body 304 for removal of solid contaminants, and replacement thereafter within the body 304. The handle is oriented off-center relative to the basket body to avoid drop-through.

Additionally, the basket 310 has a series of slotted openings 315, shown in FIG. 7 in the preferred rectangular shape with curved ends 315A joining upper and lower elongated vertical wall members 315B and 315C. The openings or slots 315 are shown in radial alignment around the side wall 312. Preferably, the alignment of the slot openings 315 is such that one vertical alignment will have a number of slot openings in excess of the next horizontally disposed vertical alignment of slot openings 315. For example, slot opening alignment 315A has four slot openings, whereas the next horizontally offset vertically aligned series has only three such slot openings 315, and so on, around the entire wall 312. The purpose of such alignment is to enhance continuous flow through the basket and resist as much as possible a reduction in the rate of fluid flow through the basket 310 as contaminant or particulate matter PM is contained therein. A series of rectangularly-shaped slot openings 315 are vertically and radially disposed through and around the side wall 312 with each of the slot openings 315 being larger than the first sized opening of the ports 314 to permit drainage fluid flow there trough into the annular area 313 and thence through the drainage conduit DC, and to screen particulate matter for retention within the basket.

Figure 3B:
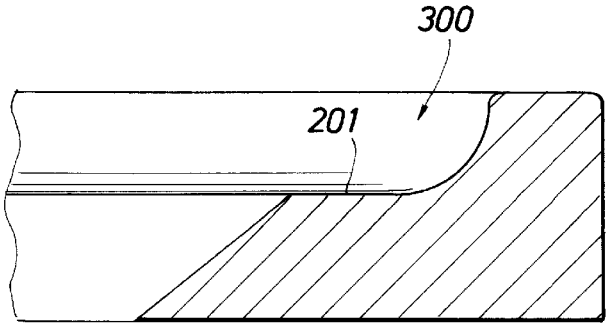
FIG. 3B is a cross-sectional horizontal view taken along line 3B—3B of FIG. 3.
Figure 4:
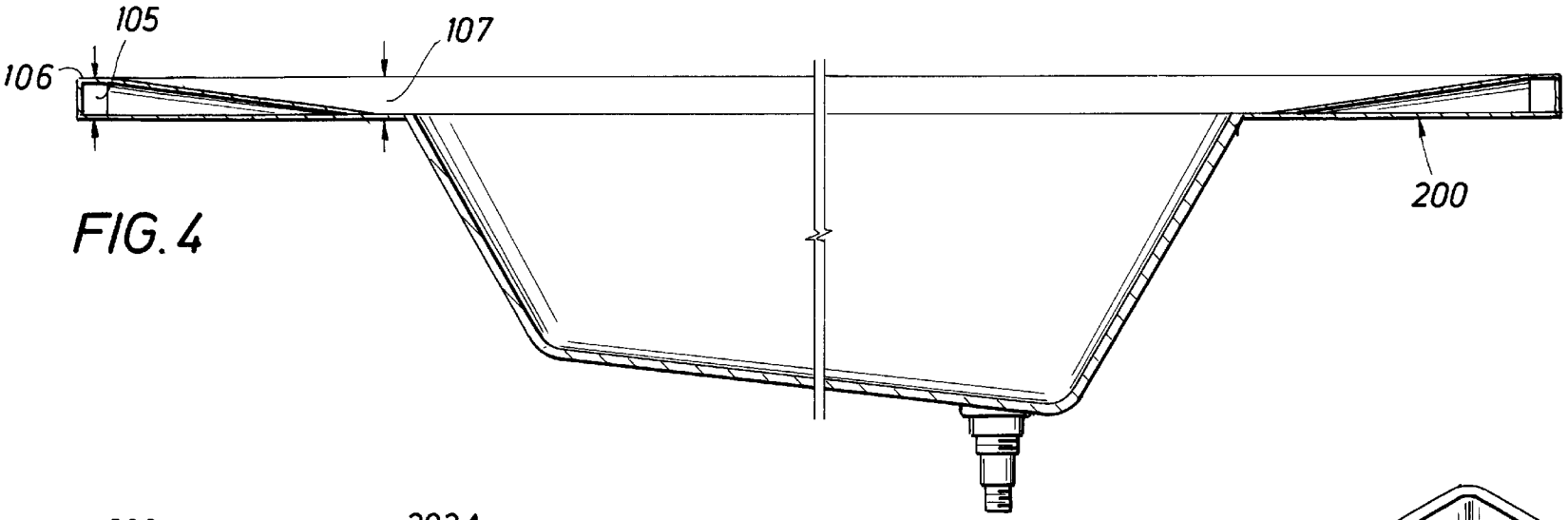
FIG. 4 is a cross-sectional horizontal view illustrating the drain apparatus including a drainage receptacle disposed within the collection area and further illustrating the use of the top edge member within the counter top of the present invention.
Figure 5:
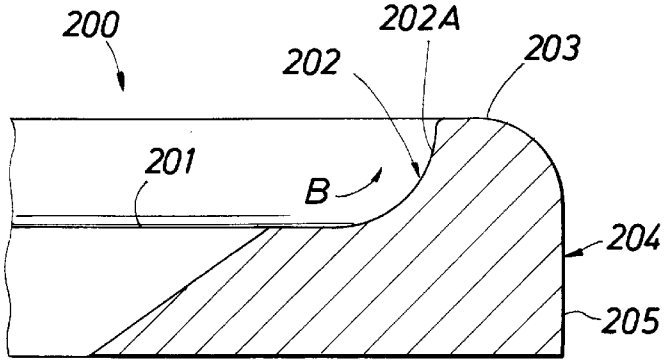
FIG. 5 is an exploded, more detailed, view of the top edge member of the present invention.

As shown in FIGS. 3, 3B, 4 and as detailed in FIG. 5, a top edge member 200 is provided for receipt of the liquid drain apparatus 100 upon a lower surface area 201. The top edge member 200 contains, as particularized in FIG. 5, an inner wall 202 intersecting a second and higher flat surface 203. The inner wall 202 has a partial circularly-configured orientation 202A, which is curved relative to an outer side wall 204. The top edge member 200 also includes a substantially vertical outer edge 205 which intersects at the top end thereof the second higher surface 203. As shown in FIG. 5, the circularly-configured orientation wall area disposed and extending from the lower surface area 201 and terminating horizontally at the second and higher surface 203 is configured such that liquid drainage captured within the lower surface area 201 resists direct splashing upon human skin or otherwise, because the contoured configuration causes the energy within a moving liquid body B disposed on the surface 201 to be dissipated as it is directed somewhat upwardly toward the second and higher surface 203 and wall portion 202A, the dissipation of the energy in the liquid drainage material being the result of the "wave" effect of the liquid as it is moved along the configuration 202A of the wall 202 and the energy being further abated by comparatively longer application and resistance of gravitational forces G upon the liquid body as it attempts to climb the configuration 202A in the wall 202. In other words, by providing the configuration or orientation 202A in the wall 202, as opposed to a substantially 90° intersection between the surface area 201 and a conventional wall extending therefrom to a higher surface, the energy within the moving liquid directed towards the outer edge 204 of the member 200 is dissipated by combination of extended gravitational forces and a "wave"-like resulting movement of the liquid B as it attempts to climb the configured wall 202. The slope or orientation 202A permits the "wave"-like movement of the liquid, thus resulting in more surface area of the drainage liquid B being exposed to gravitational forces for a more extended period of time than in conventional and prior art configured edge elements.

Preferably, the slope of the walls 109 of the ribs 108 will be at a minimum of about 4°. However, the selected degree of the slope will be dependent upon other design parameters known to those skilled in the art in particularizing a preferred drainage profile configuration for a desired counter top or drainage apparatus. Moreover, and preferably the width of the bottom of the respective valleys should be somewhat greater than the width of the respective ribs at the top 108A of the respective rib 108.

The counter top C is preferably provided in a molded configuration which includes the drain apparatus 100 such that the ribs and valleys defined therein are included within the molded configuration of the apparatus 100 within the counter top C. If a molding technique is not used to provide the counter top C including the liquid drain apparatus 100, the ribs and valleys 108, 110 may be provided as separate, but completely integrated, components.

Alteratively, the ribs and valleys, 108, 110, may be provided such that there is no substantial slope there between, and such elements are provided in a "V"-shaped configuration. However, this is certainly not the preferred configuration but, as used herein and in the claims, "U"-shaped configuration should be generically defined to include "V"-shaped or other inwardly sloping configurations, as suggested herein.

Finally, it will be appreciated that the drainage receptacle 300 of the present invention may be incorporated into a counter top that is of conventional nature, such as the prior art tops illustrated in the prior art configurations described herein. It will also be appreciated that by providing the slotted openings having a size larger than the openings in the lower wall of the basket, fluid flow will be directed exteriorly through the openings in the wall as opposed to downwardly and out of the bottom of the ports in the basket thereby enhancing continuous fluid flow through the basket such that particulate matter may gravitate to the bottom of the basket and be collected thereat while fluid flow rate continues substantially unabated as long as possible as contaminate material continues to collect at the bottom of the basket.

Although the invention has been described in terms of specified embodiment which are set forth in detail, it should be understood that this is by illustration only that the invention is not necessarily limited thereto, since alternatively embodiments and operating techniques will become apparent to those skilled in the art in view of the disclosure. Accordingly modifications are contemplated which can be made without departing from the spirit of the described invention.

What is claimed and desired to be secured by Letters Patent is:

1. A liquid drain apparatus incorporable within a counter top, comprising:

(a) at least one epoxy, resin-based solid body having an outboard end and an inboard end defined within said top, said body having a given height defined from a first height point therein and further including a smooth top surface defining a second height point;

(b) a plurality of parallel ribs vertically defined through said body having sloping walls within said body and extending upwardly through the given height from the first height point and terminating at substantially the second height point;

(c) a valley member disposed between each of said ribs in "U"-shaped configuration and vertically extending upwardly from the said first height point, each of said valley members having a plurality of vertically sloping valley wall elements which also define the walls of the ribs, said valley members being horizontally defined within said body between said outboard and inboard ends;

(d) a collection area within said body adjacent the body inboard end for receipt of a draining receptacle, the height of each of said valleys from said outboard end to said inboard end gradually horizontally increasing therebetween, whereby the flow of drainage liquid collecting between said valleys and ribs is gravitationally directed for collection within said draining receptacle; and (e) draining receptacle positionable within said collection area and including a circular shoulder extending to an opening therethrough for receipt of a solids trap assembly, said solids trap assembly including: (1) an elongated cylindrical body having an outwardly extending lip for positioning of said cylindrical body along the shouldered opening; (2) means for securing a cylindrical body to the draining receptacle; (3) means for securing the drainage conduit to one end of the cylindrical body; (4) an inwardly protruding shoulder extending around the interior of said cylindrical body immediate one end thereof; (5) a removable basket insertable within said cylindrical body and including a lower end intersecting a continuous side wall and positionable upon and removable from said inwardly protruding shoulder by hand; (6) an annular flow area defined between the exterior of the wall of the basket and the interior of the cylindrical body; (7) a series of ports having a first size disposed through the basket's lower end; and (8) a series of rectangularly-shaped slot openings vertically and radially disposed through and around said side wall, each of said slot openings being larger than the first sized opening of the ports to permit drainage fluid flow therethrough into the annular area and thence through the drainage conduit, and to screen particulate matter for retention within the basket, said counter top further comprising a top edge member, said top edge member having a lower surface area in substantially horizontal alignment with said outboard end and further including an inner wall area surrounding said lower surface area and extending upwardly away and slopingly from said lower surface area toward a second and higher surface area in a partial circularly configured orientation.

2. The liquid drain apparatus of claim 1: said top edge member further including a curved outer side wall extending between said second and higher surface area and a substantially vertical outer edge, and away from said lower surface area.

* * * * *